United States Patent [19]

Kobe

[11] 4,426,823

[45] Jan. 24, 1984

[54] APPARATUS AND METHOD FOR MOUNTING ROOFING TILE

[76] Inventor: Thomas R. Kobe, 2465 Wild Oak Dr., Los Angeles, Calif. 90068

[21] Appl. No.: 269,480

[22] Filed: Jun. 2, 1981

[51] Int. Cl.[3] ..... E04B 1/00

[52] U.S. Cl. ..... 52/748; 52/544; 52/551

[58] Field of Search ..... 52/748, 544, 506, 551, 52/664, 553, 676, 547, 537

[56] References Cited

U.S. PATENT DOCUMENTS

| | | | |
|---|---|---|---|
| 560,531 | 5/1896 | Orr | 52/676 |
| 1,715,243 | 5/1929 | McManamay | 52/748 X |
| 1,854,660 | 4/1932 | Martin | 52/551 |
| 1,952,317 | 3/1934 | Holder | 52/551 |
| 2,002,206 | 5/1935 | Kobe | 52/543 |
| 2,084,609 | 6/1937 | Corcoran | 52/551 X |
| 2,152,080 | 3/1939 | Munsey | 52/748 X |
| 2,511,083 | 6/1950 | Small | 52/547 |
| 3,950,911 | 4/1976 | Fox, Jr. | 52/664 |

*Primary Examiner*—Carl D. Friedman
*Attorney, Agent, or Firm*—Boniard I. Brown

[57] ABSTRACT

Apparatus for mounting associated roofing tile which in one form of the invention includes a grid of wires which comprises a plurality of first wires disposed in a first direction and a plurality of second wires disposed in a second direction. The second direction is generally perpendicular to the first direction. A first hook cooperates with each tile and one of the first wires.

6 Claims, 14 Drawing Figures

FIG-1
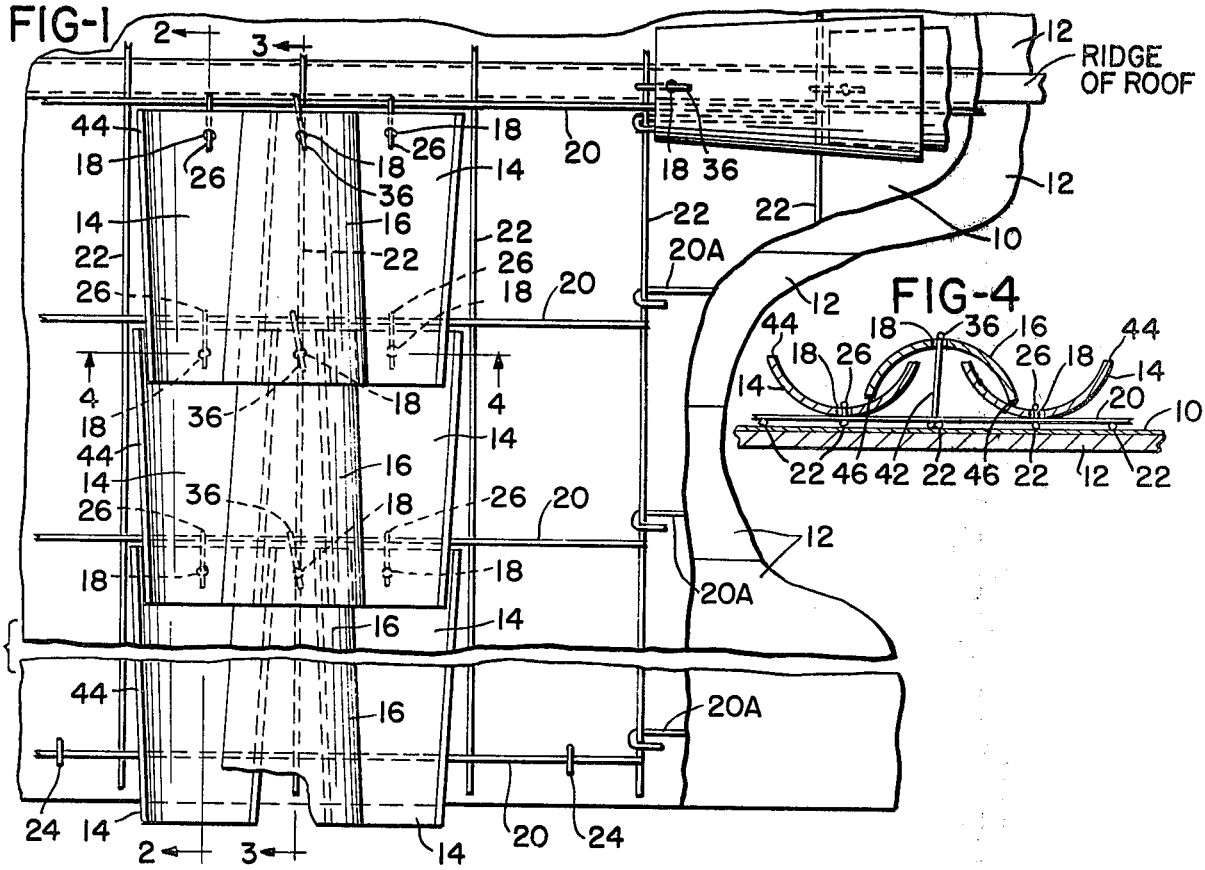
FIG-4
FIG-2
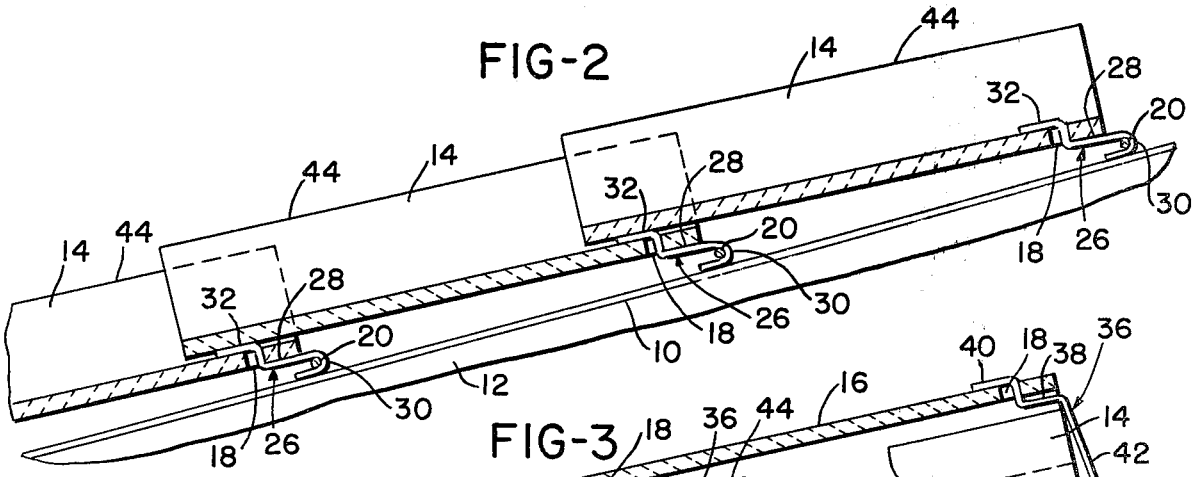
FIG-3
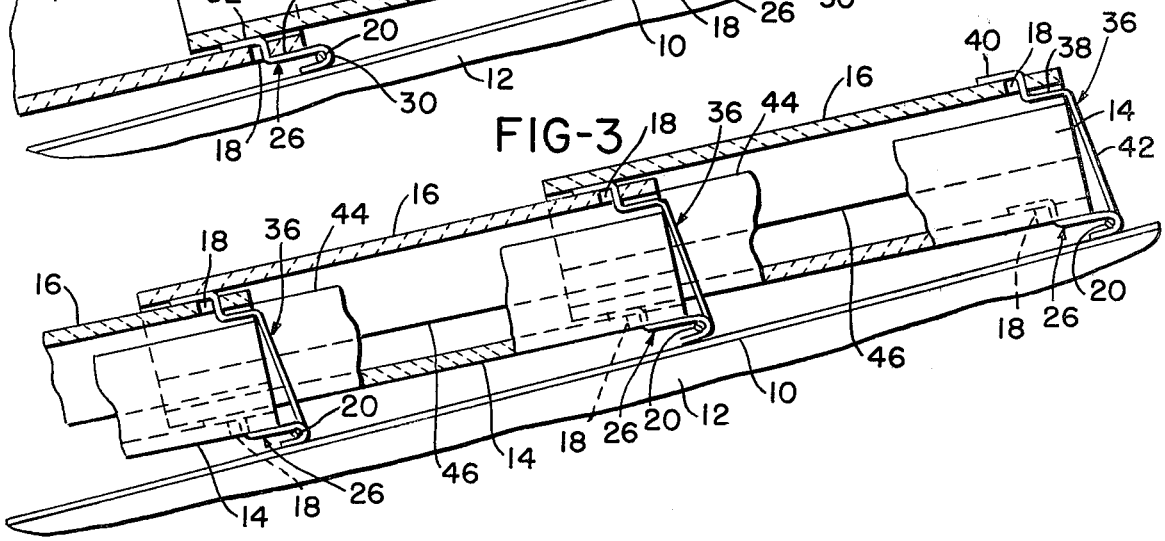

APPARATUS AND METHOD FOR MOUNTING ROOFING TILE

BACKGROUND OF THE INVENTION

The invention relates to building construction and particularly to methods and apparatus for fabricating tile roofs. Various types of tile roofs are known including those using two piece mission (a tapered tile), two piece straight barrel tile, Spanish, shingle, semi-flat and Italian or Florentine tile. In two piece roof constructions, lower or pan tiles are positioned in rows, usually with the convex side downward and adjacent to a waterproof membrane which is on top of sheathing. The rows extend "vertically." The upper or cover tiles are also disposed in "vertically" extending rows which are substantially intermediate the rows of pan tiles. The upper or cover tiles ordinarily will have their convex sides disposed upward and away from the waterproof membrane. The upper tiles will usually be disposed with their axially extending marginal portion overlapping the pan tiles. The pan and cover tiles are sometimes referred to, respectively, as gutter and field tiles.

For ease of description, the terms "horizontal" and "vertical" will be used here to describe certain orientations. The term "horizontal" will be understood to refer to a direction, along the surface of the roof, which is parallel to the ridge and eave of the roof on which the invention is utilized. The term "vertical" will be understood to refer to a direction along the surface of the roof which is perpendicular to a "horizontal" line running along the roof. It will be clear that since most roofs do not have surfaces which extend in normal relation to the surface of the earth, that the vertical orientation does not literally exist, but that this is a term used merely to facilitate describing the invention.

In general, such tile roofs have been constructed by using a nail which passes through a hole in each tile. See for example, U.S. Pat. No. 2,002,206 which issued to the present applicant on May 21, 1935. That patent relates to a construction which utilizes an axially tapered shell which contains a plastic cement material. A nail is driven through this material and also through a membrane which is disposed intermediate the sheathing and the tile. The plastic cement material has the desirable attribute of providing a positive seal around the nail and the interface of the nail with the membrane.

It will be understood that the tiles in such constructions typically are manufactured of a relatively porous material and that the membrane, which is disposed under the tile and above the sheathing, is relied on to provide an effective weather seal to keep out water and the like. Although the apparatus in accordance with the above referred to patent does provide a significant improvement, it does have certain drawbacks. Such nailing, for example, typically requires the use of wooden strips to mount the courses of tiles which are to be secured to the roof. Other difficulties with some of the known apparatus and methods is that some of them will not be suitable for use on a variety of tile shapes. Others require the driving of nails through the membrane.

Accordingly, it is an object of the invention to provide apparatus and a method for fabricating a tile roof that has improved sealing characteristics.

It is another object of the apparatus and method in accordance with the invention to provide an invention which is capable of being used with a wide variety of shapes and sizes of tile.

Another object of the invention is to provide a method and apparatus which eliminates the driving of nails through a sealing membrane.

Another object of the invention is to provide apparatus which eliminates the requirement of mounting a plurality of wooden strips on the surface of the roof which is to be resurfaced.

Still another object of the invention is to provide a method and apparatus which eliminates the requirement for marking the surface of the roof with a chalk line.

Yet another object of the invention is to provide an apparatus which is easy to use and suitable for use by "do-it-yourselfers."

SUMMARY OF THE INVENTION

The foregoing objects and other objects and advantages which shall become apparent from the detailed description of the preferred embodiment are attained in an apparatus for mounting associated roofing tile which includes a grid of wires which comprises a plurality of first wires disposed in a first direction and a plurality of second wires disposed in a second direction. The second direction is generally perpendicular to the first direction. A first hook cooperates with each tile and with one of the first wires.

The apparatus is intended to cooperate with associated cover and pan tile and the apparatus may include first and second types of hooks, the first type of hook may have an elongated rectilinear axial section and a generally U-shaped axial extremity and a generally L-shaped axial extremity. The second hook may include an elongated rectilinear axial section having an L-shaped axial extremity at one end and a U-shaped axial extremity at the other end, with the free ends of each axial extremity extending in the same general direction.

Each portion of the first hook may be disposed in substantially coplanar relationship. The second hook may have each of the portions thereof disposed in substantially coplanar relationship. The apparatus may further include a generally S-shaped hook having axial extremities which may engage the axial extremities of overlapping cover tile. Some of the hooks may include an elongated rectilinear axial section having disposed respectively at the axial extremities thereof a generally L-shaped member and a generally loop-shaped member.

The invention also contemplates the method of installing roofing tile which utilizes a membrane which is covered by a grid of wires. Thereafter hooks are positioned to connect the tiles to the grid.

BRIEF DESCRIPTION OF THE ACCOMPANYING DRAWING

FIG. 1 is a plan view of a portion of a tile roof constructed in accordance with the present invention;

FIG. 2 is a sectional view taken along the line 2—2 of FIG. 1;

FIG. 3 is a sectional view taken along the line 3—3 of FIG. 1;

FIG. 4 is a sectional view taken along the line 4—4 of FIG. 1;

DESCRIPTION OF THE PREFERRED EMBODIMENT

Figure 5:
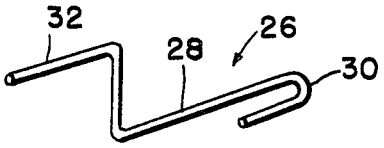
FIG. 5 is a perspective view of a hook intended for cooperation with a pan tile and the wire grid in accordance with the invention and which is illustrated in FIGS. 1, 2, 3 and 4.

Referring now to FIGS. 1–6, there is shown a roof construction which includes a membrane of paper 10 which covers the sheathing 12 to provide a water impervious covering. Such membranes 10 ordinarily are pierced by nails (not shown) which support the pan tiles 14 and cover tiles 16 on sheathing 12. Such nails ordinarily pass through hole 18 in each tile. The holes 18 are provided at the time the tiles are manufactured.

In practicing one form of the invention the grid of horizontal wires 20 and vertical wires 22 is positioned on the roof of the house on which the tiles are to be mounted. The grid wires 20 and 22 are ordinarily positioned with the horizontal wires disposed in generally parallel relationship to the ridge or peak (not shown) of the roof on which the tile are to be mounted. The grid extends down the sides of the roof from the ridge. In other words, a single grid covers both sides of a roof. The grid is secured, ordinarily, only at the lower most extremities thereof. These extremities are at the eaves. The manner of fastening the grid is ordinarily by means of the staples 24.

In a typical embodiment, the vertical wires 22 will be spaced at 10½ inch intervals along the horizontal wires 20. The horizontal wires 20 will be spaced at 14 inch intervals along the vertical wires 22. The staples 24 will be one inch staples and ordinarily one staple 24 will be utilized intermediate adjacent vertical wires 22. The staple 24, as well as the wire wires 20,22, may be manufactured of Brass, galvanized iron, or lacquered or copper coated black iron. The junctures of the horizontal wires 20 and the vertical wires 22 ordinarily will include a weld or twisted connection at each intersection.

Each pan tile 14 is secured by a hook 26 which is best illustrated in FIGS. 2, 3, and 5. The hook 26 includes an elongated rectilinear section 28, an axially adjacent U-shaped section 30, and at the other axial extremity an L-shaped section 32. The U-shaped section 30 and the L-shaped section 32 are disposed in generally coplanar relationship.

Each cover tile is joined to a horizontal wire 20 by means of a hook 36. The hook 36 has an axial section 38 which is rectilinear. The rectilinear section 38 is joined at one end by an L-shaped section 40 and at the other by a U-shaped section 42. The L-shaped sections 40 and 42 are disposed in generally coplanar relationship with the axial extremities thereof most remote from the rectilinear section 38 extending in substantially the same direction.

In operation it will be seen that the U-shaped bend 30 of the hook 26 engages the horizontal wire 20 and the L-shaped end 32 of the hook 26 engages the pan tile 14 as best illustrated in FIGS. 2 and 3. In a similar manner the hook 36 engages the horizontal wire 20 by means of the U-shaped extremity 42 thereof. The L-shaped extremity 40 of the hook 36 engages the cover tile 16.

In the view of FIG. 3 it will be understood that the pan tile 14 upper edge is visible and that the pan tile 14 has been broken away to better illustrate the relationship of the various elements. Similarly the bottom edge 46 of the cover tile 16 is also visible in FIG. 3 as well as in FIG. 4.

Figure 7:
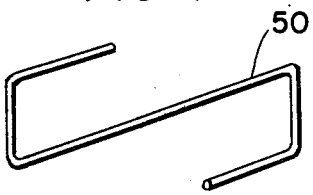
FIG. 7 is a perspective view of an alternate hook for cooperation with the cover tile and the wire grid in accordance with the invention.
Figure 8:
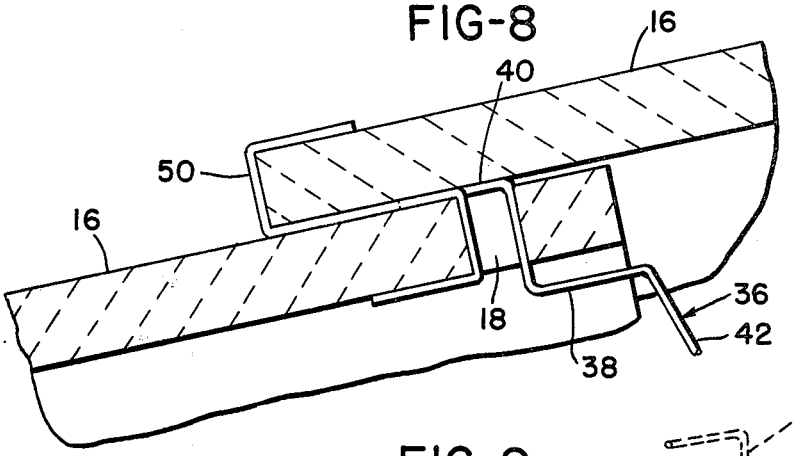
FIG. 8 is a sectional view, similar to that of FIG. 3, which illustrates the manner of cooperation of the hook illustrated in FIG. 7 with so called shingle tile.

FIGS. 7 and 8 illustrate an alternate embodiment of the invention which includes the use of an additional hook member 50 which is used in cooperation with the apparatus described above. More particularly the generally S-shaped hook 50 is disposed so that it extends around the axial extremity of overlapping cover tiles 16 as best illustrated in FIG. 8. The hook 50 is particularly desirable to insure that the cover tile 16 is not inadvertently dislodged by winds, earth quake or other means.

Figure 9:
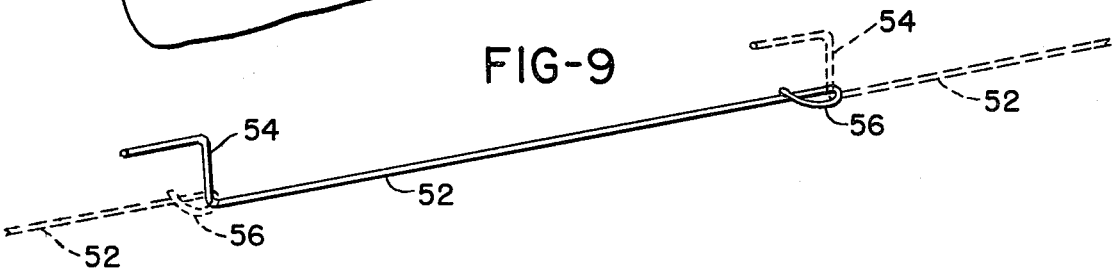
FIG. 9 is a perspective view of still another embodiment of a hook for cooperation with a pan tile.
Figure 10:
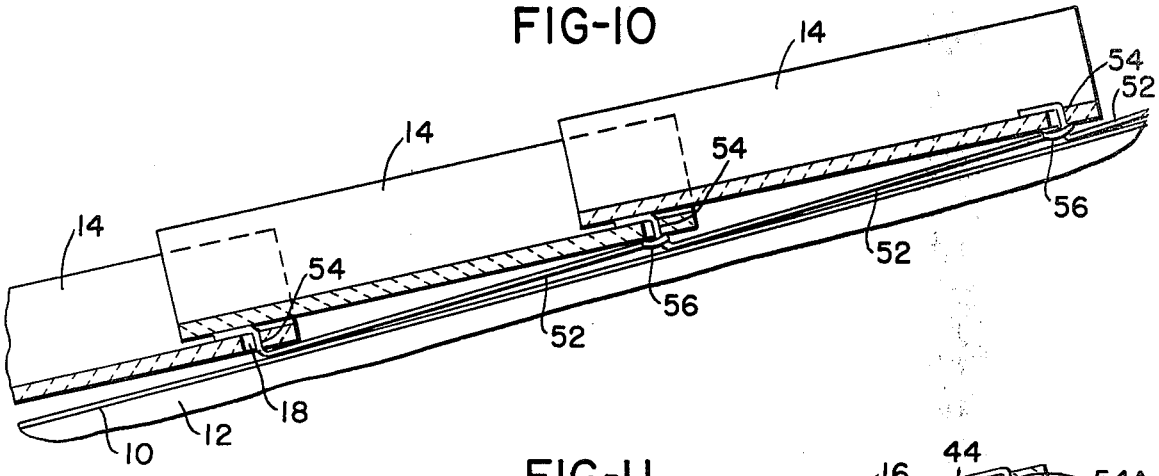
FIG. 10 is a sectional view similar to that in FIG. 8 illustrating the manner of operation of the hook illustrated in FIG. 9.

Referring now to FIGS. 9 and 10 there is shown still another embodiment of the invention in which hooks 52 are provided which have an elongated rectilinear axial section and at respectively the extremities thereof, an L-shaped member 54 and a looped member 56. As best seen in FIG. 9 the loop member 56 engages the L-shaped member 54 which also engages the pan tile 14. The uppermost hook 52 is secured by a fastener (not shown) to the sheathing.

Figure 9A:
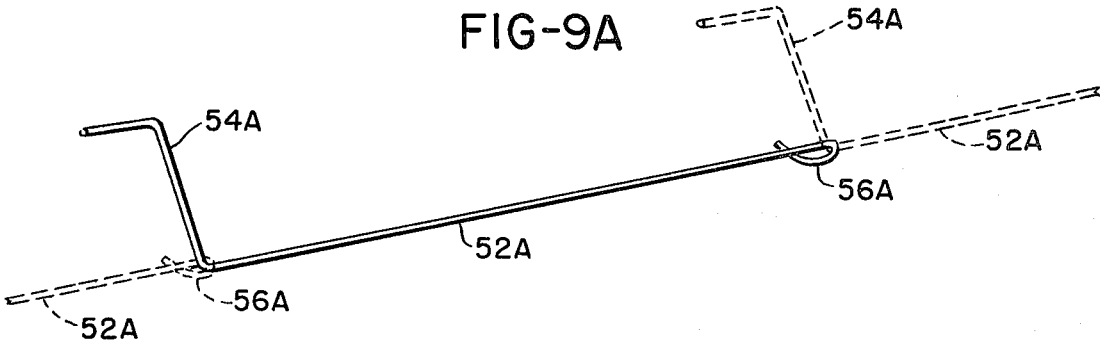
FIG. 9A is a perspective view of another embodiment of a hook, which is similar to that of FIG. 9, for cooperation with a cover tile.
Figure 11:
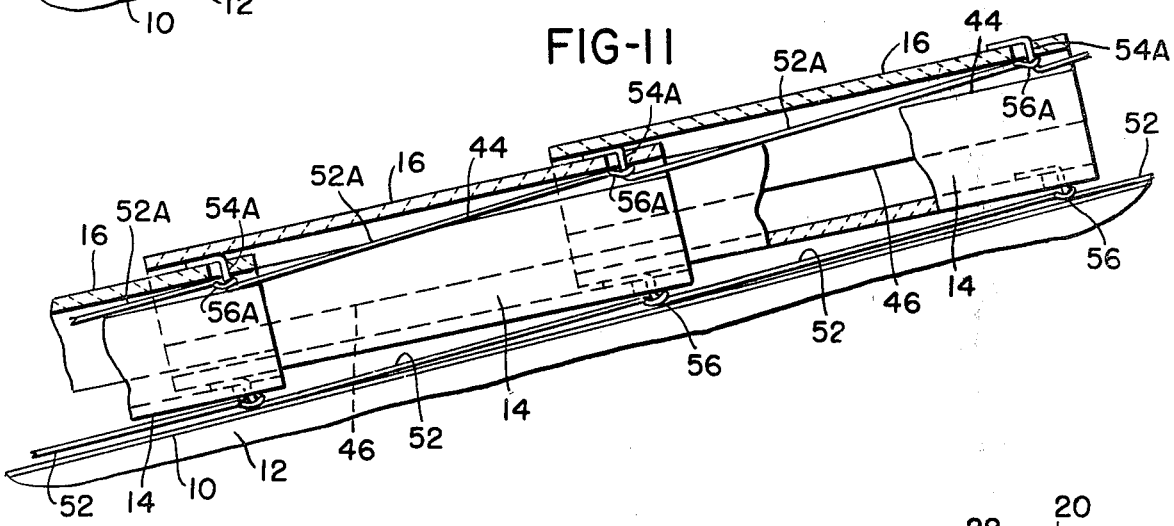
FIG. 11 is a sectional view similar to that in FIG. 9 illustrating the manner of operation of the hooks illustrated in FIG. 9.

Similarly, FIGS. 9A and 11 show another embodiment of the invention in which hooks 52A are provided having an L-shaped contour at one end 54A and a loop member 56A at the other end. The end 54A extends intermediate overlapping cover tiles 16.

It will be understood that the sizing of various portions of the various hooks will vary with the size of the tile which are being utilized. Similarly, the size of the wire grid will also vary with the size of the tile utilized.

Figure 6:
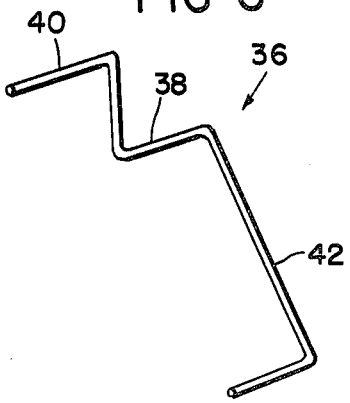
FIG. 6 is a perspective view of a hook for cooperation with a cover tile and the wire grid in accordance with the invention and which is illustrated in FIGS. 1, 3 and 4.
Figure 12:
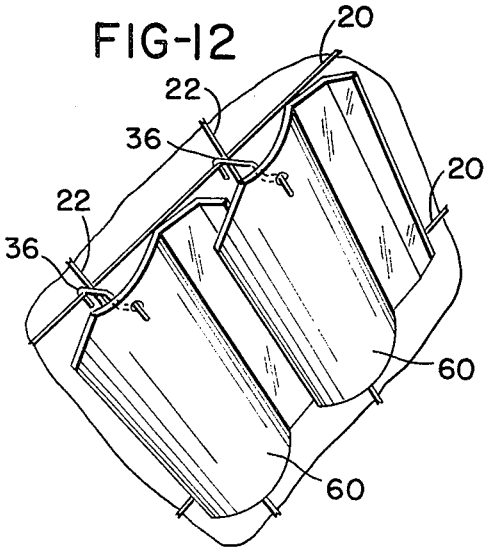
FIG. 12 is a partial perspective view illustrating the mounting of one piece Spanish "S" tile using the hooks illustrated in FIG. 6.
Figure 13:
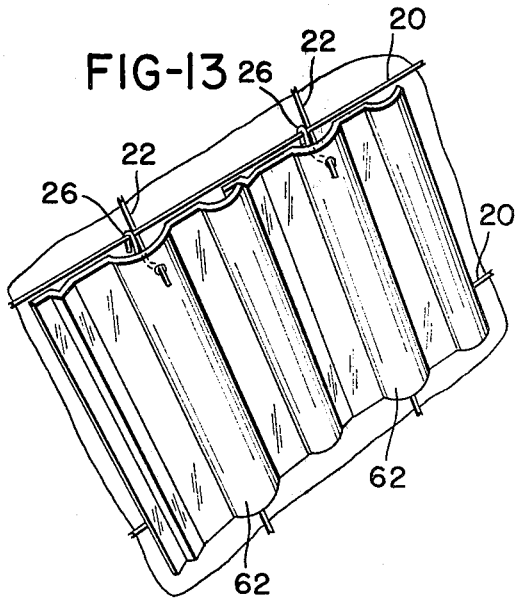
FIG. 13 is a partial perspective view illustrating the mounting of one piece semi-flat tile using the hooks illustrated in FIG. 6.

FIGS. 12 and 13 show respectively the mounting of one piece Spanish "S" tile 60 and one piece semi-flat tile 62 with respectively the hooks 36 and 26 illustrated in FIGS. 6 and 5. These figures illustrate some of the various types of tile that may be mounted. Different tile types may require different dimensions as indicated above. These figures also show the cooperating vertical and horizontal wires 22, 20.

The invention requires only the attachment of the grid of horizontal wires 20 and vertical wires 22 at the eaves. Thus, sealing is required only at these locations and the over all necessity for sealing around the membrane 10 is substantially minimized. This also reduces the probability of failure of the membrane 10 and thus insures long life for the entire roof. The time saving is particularly significant since the necessity for caulking around a large number of nail holes is eliminated.

The installation on the roofing in accordance with the invention is ordinarily accomplished by initially installing the membrane 10, installing the grid of wires 20, 22, tacking the grid at the eaves and then installing the tile starting at the eaves and working up toward the ridge. In some cases, it may be most desirable to install the hooks on the horizontal wires 20 and then attach the tiles. In other cases it may be more desirable to initially attach the hooks to the tiles and than attach the hooks to the horizontal wires 20. The grid of wires 20, 22 will ordinarily be prefabricated and supplied in a roll, like wire fencing, so that the user can merely position it on the roof on which the tiles are to be installed. It will be seen that the necessity for using a chalk line is eliminated. The wires of the grid are preassembled to have the precise geometric relationship which is desired. The provision of a plurality of horizontal wires 20 makes it easy for the user to merely position one such wire exactly along the ridge of the roof on which the tiles are to be installed. Similarly, wood nailing strips are not required in either the verical or horizontal direction. This is a significant advantage since the installation, which was required previously, was a time consuming operation.

The hooks 26, 36 and 50 ordinarily will be manufactured of Brass, galvanized iron, or lacquered or copper coated black iron as are the wires 20, 22 and the staples 24. Ordinarily the same material will be utilized for each of these elements to avoid any possible galvanic action.

In some embodiments a first group of grid wires 20, 22 may cover one portion of the roof and a lateraly adjacent second group of grid wires 20, 22 may be fastened to the first group of grid wires 20, 22 by J-shaped hooks 20A.

The invention has been described with reference to its illustrated preferred embodiment. Persons skilled in the field of constructing tile roofs may, upon exposure to the teachings herein, conceive variations in the mechanical development of the components therein. For example, the wires described herein may be replaced by cables or other similar members without departing from the spirit of the invention. Such variations are deemed to be encompassed by the disclosure, the invention being delimited only by the appended claims.

The inventor claims:

1. The method of installing tiles on a roof which comprises:

installing a water impervious membrane over the surface to be covered;

providing a grid of wires having a plurality of first wires disposed in a first direction and a plurality of second wires disposed in a second direction, said second direction being generally perpendicular to said first direction;

positioning the grid of wires over the roof to be covered with said grid extending over the ridge of the associated roof and down to the eaves on each side thereof, one of said first wires being disposed in substantially parallel closely spaced relationship with the ridge of the associated roof securing said grid to said roof; and fastening a plurality of tiles to said wires extending in said first direction by means of a plurality of hooks.

2. The method as described in claim 1, wherein:

at least some of the tiles are pan tiles; and the method further includes providing hooks for use with the pan tiles, having an elongated rectilinear axial section which is joined by a generally L-shaped axial extremity at one end and a generally U-shaped axial extremity at the other end thereof.

3. The method as described in claim 2, further including:

the step of providing a plurality of hooks for joining at least some of said tiles to said wires extending in said first direction, at least some of said hooks comprising an elongated rectilinear section and, at the respective axial extremities thereof a generally L-shaped axial extremity and at the other axial extremity a generally U-shaped axial extremity, the free ends of said extremities extending in the same direction.

4. The method as described in claim 2 or 3, wherein:

said providing step includes providing hooks having all portions disposed in substantially coplanar relationship.

5. The method as described in claim 4, wherein:

at least some of the tiles are cover tiles;

said providing step further includes providing a generally S-shaped hook; and further including the step of installing said generally S-shaped hook with the axial extremities thereof engaging overlapping sections of associated cover tile.

6. The method as described in claim 1, wherein:

said providing step includes providing discrete laterally adjacent grids of wires.

* * * * *